US007179124B2

(12) United States Patent
Zhang et al.

(10) Patent No.: US 7,179,124 B2
(45) Date of Patent: Feb. 20, 2007

(54) ELECTRICAL CONNECTOR

(75) Inventors: AnYi Zhang, Kunsan (CN); Zhi-Qiang Chen, Kunsan (CN)

(73) Assignee: Hon Hai Precision Ind. Co., Ltd, Taipei Hsien (TW)

( * ) Notice: Subject to any disclaimer, the term of this patent is extended or adjusted under 35 U.S.C. 154(b) by 0 days.

(21) Appl. No.: 11/173,372

(22) Filed: Jun. 30, 2005

(65) Prior Publication Data

US 2006/0052005 A1 Mar. 9, 2006

(30) Foreign Application Priority Data

Sep. 9, 2004 (CN) ..... 2004 2 00794879

(51) Int. Cl.
*H01R 13/648* (2006.01)

(52) U.S. Cl. ..... 439/607; 439/188

(58) Field of Classification Search ..... 439/188, 439/607

See application file for complete search history.

(56) References Cited

U.S. PATENT DOCUMENTS 4,861,271 A * 8/1989 Bogar et al. ..... 439/63
5,927,999 A 7/1999 Shimojyo
6,551,115 B1 * 4/2003 Li et al. ..... 439/79
6,764,338 B2 * 7/2004 Fang ..... 439/607

FOREIGN PATENT DOCUMENTS

CN 2499996 Y 7/2002
CN 2549606 Y 5/2003

* cited by examiner

*Primary Examiner*—Truc Nguyen
(74) *Attorney, Agent, or Firm*—Wei Te Chung

(57) ABSTRACT

An electrical connector comprises an insulating housing comprising a mating face and two side faces and defining a receiving chamber extending through the mating face along a mating direction thereof; a first contact disposed in the housing; a second contact received in the housing and comprising an engaging portion protruding into the receiving chamber; and a shield covering the housing and formed with at least a pair of soldering arms located outside the one of the side faces of the housing and spaced from each other along the mating direction, the soldering portion of the first contact located between the two soldering arms of the shield outside the one of the side faces of the housing.

10 Claims, 5 Drawing Sheets

ELECTRICAL CONNECTOR

BACKGROUND OF THE INVENTION

1. Field of the Invention

The present invention relates to an electrical connector, especially to a power connector.

2. Description of Related Art

Electrical connectors are widely used in the field of the electronics to accomplish power or signal transmission between complementary connectors and printed circuit boards. For transmitting power or signal steadily, it is needed to ensure a certain contact force while the electrical connector engaging with the complementary connector. Because of the contact force, a pushing/pulling force between the electrical connector and the complementary connector arises when the complementary connector is inserted or drawn out. However, when the complementary connector is insert or drawn out frequently, contacts of the electrical connector will be suffered from malfunction. Thus, the power or signal transmission between the contacts of the electrical connector and the printed circuit board will be adversely affected.

CN Pat. No. 01260932.3 and CN Pat. No. 02234066.1 both disclose an electrical connector comprising a shield and resilient contacts. The shield and the resilient contacts are both soldered on a printed circuit board. When a complementary connector is inserted into or drawn out from the electrical connector, the shield bears a part of a pushing/pulling force produced by the complementary connector. Thus the pushing/pulling force born by the resilient contacts decreases. However, the resilient contacts located behind the shield along engaging direction, majority of the pushing/pulling force, especially the pushing force, is still befell on the resilient contacts. When the complementary connector is insert or drawn out frequently, the resilient contacts will be still suffer from malfunction. Thus the power or signal transmission between the resilient contacts and the printed circuit board is affected also.

Hence, an improved electrical connector is required to overcome the disadvantages of the prior art.

SUMMARY OF THE INVENTION

An object of the present invention is to provide an electrical connector which can protect conductive contacts.

Accordingly, to achieve above-mentioned object, An electrical connector comprises an insulating housing comprising a mating face and a pair of side faces and defining a receiving chamber extending through the mating face along a mating direction thereof; a first contact disposed in the housing and comprising a contacting portion exposed into the receiving chamber and a soldering portion located outside one of the side faces of the housing; a second contact received in the housing and comprising an engaging portion protruding into the receiving chamber and located apart from the contacting portion of the first contact; and a shield covering the housing and formed with at least a pair of soldering arms located outside the one of the side faces of the housing and spaced from each other along the mating direction, the soldering portion of the first contact located between the two soldering arms of the shield outside the one of the side faces of the housing.

The detailed features of the present invention will be apparent in the detailed description with appropriate reference to the accompanying drawings.

DETAILED DESCRIPTION OF THE INVENTION

Figure 1:
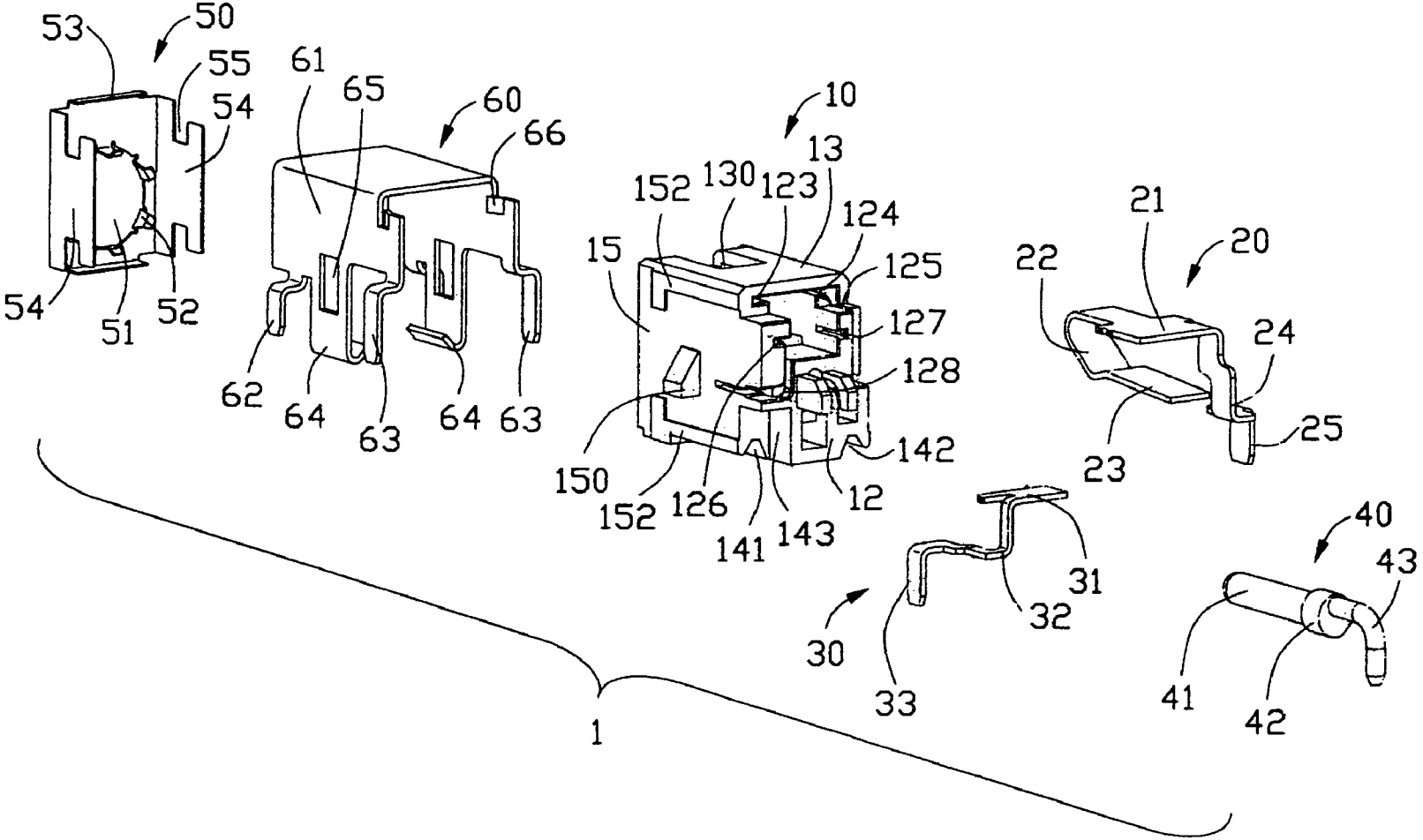
FIG. 1 is an exploded perspective view of an electrical connector in accordance with the present invention.

Referring to FIG. 1, an electrical connector 1 in accordance with the present invention comprises an insulative housing 10, a first contact 20, an inspecting contact 30 and a second contact 40, a shield comprising a front shield 50 and a rear shield 60.

Referring to FIGS. 1 to 4, the housing 10 approximately in the shape of a cubical block has a front face 11, a rear 12, a top face 13, a bottom face 14 and two side faces 15 and the front face 11 is served as a mating face, the housing 10 defines a mating direction along the front to rear direction. A tube-like receiving chamber 16 is defined within the housing 10 extending through the front face 10 thereof. An opening 130 is defined on the top face 13 adjacent the front face 11, downwardly communicating with the receiving chamber 16, functioning as radiator for dispelling the heat during the power or signal transmitting.

A pair of concaves 141,142 are formed on opposite sides of the bottom face 14 of the housing 10 along the front to rear direction and the housing 10 defines a space 143 on end of the concave 141 of the bottom face 14 adjacent the rear face 12 for making the electrical connector engage with printed circuit board correctly. Additionally, the housing 10 is provided with a pair of protuberances 150 symmetrically formed on the side faces 15 thereof. The housing 10 also has protruding portions 152 formed at edges on the top face 13 and the bottom face 14 adjacent the side faces 15.

Figure 3:
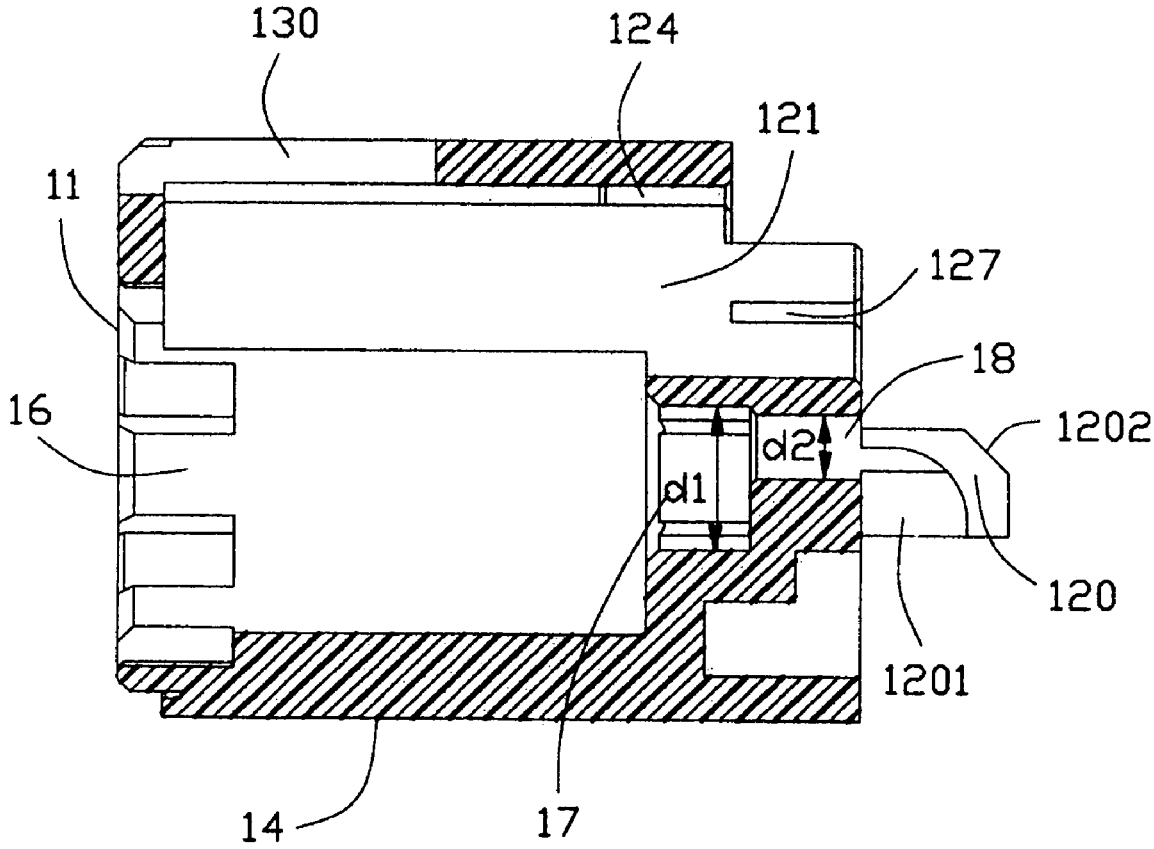
FIG. 3 is a cross-sectional view taken along line 4—4 shown in FIG. 2 showing an insulative housing of the electrical connector.
Figure 5:
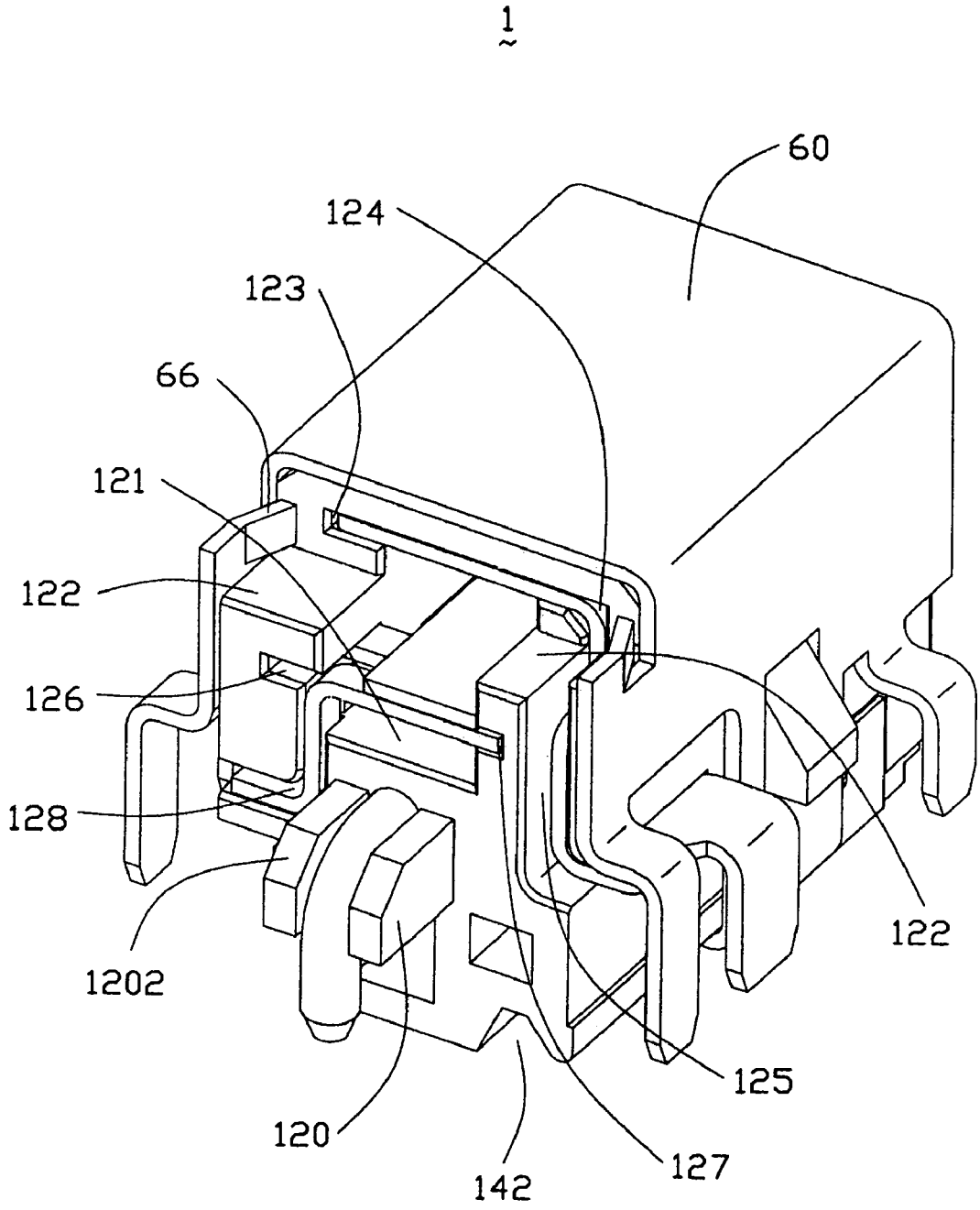
FIG. 5 is an assembled perspective view similar to FIG. 2 but taken from another aspect.

Referring to FIGS. 3 and 5, the housing 10 has a pair of projections 120 projecting from the center of the rear face 12. A receiving hole (not labeled) extending throughout opposite inner surfaces of the pair of projections 120 and comprising a front section 17 and a rear section 18 is defined within the housing 10, the front section 17 extends from end of the receiving chamber 16 and communicates with it. A diameter (d1) of the front section 17 is larger than a diameter (d2) of the rear section 18. Axis of the receiving chamber 16 is in alignment with that of the front section 17 and axis of the rear section 18 isn't in alignment with that of the receiving chamber 16 and of the front section 17. The projections 120 are formed on opposite sides of end of the rear section 18 through the rear face 12 and define a pair of opposite blocks 1201 on the inner surfaces thereof. A pair of sloping portions 1201 are formed on corresponding ends of the projections 120 away from the rear face 12. A rectangle aperture 121 is defined above the projections 120 and extending into the housing 10, communicating with the receiving chamber 16 and the opening 130. The housing 10 defines a step portion 122 formed on one end of the top face 13 adjacent the rear face 12 thereof, communicating with the rectangle aperture 121. The housing 10 defines a pair of first receiving passages 123, 124 at corners on the rectangle aperture 121 and the top face 13. One end of the first receiving passage 124 away from the rectangle aperture 121 extends downwardly and parallel the side faces 15, creating a first slot 125 being in the shape of "L" within one side of the side faces 15. Then, end of the slot 125 extends throughout the one side of the side faces 15 perpendicular the side faces 15. Additionally, the housing 10 defines a pair of second receiving passages 126, 127 formed on the opposite sides of the rectangle aperture 121 and below the step portion 122 thereof. One end of the second receiving passage 126, which is communicates with the rectangle aperture 121, extends downwardly and parallel the side faces 15, creating a second slot 128 being in the shape of "L" within another side of side faces 15. Then, end of the slot 128 extends throughout the corresponding another side of the side faces 15 perpendicularly to the side faces 15.

Referring to FIG. 1, the first contact 20 comprises a main body 21, a contacting portion 22 extending and bending downwardly from one side of the main body 21 and being U-Shaped, a jointing portion 23 extending from a free end of the contacting portion 22, a connecting portion 24 extending downwardly from another side of the main body 21 and being L-Shaped and a soldering portion 25 extending downwardly outside the side face 15 from end of the connecting portion 24. The inspecting contact 30 for inspecting power or signal comprises a main body 31, a connecting portion 32 extending downwardly from one side of the main body 31 and being L-Shaped and a soldering portion 33 extending forwardly from one side of the end of the connecting portion 32 and then extending downwardly outside the another side face 15.

Figure 4:
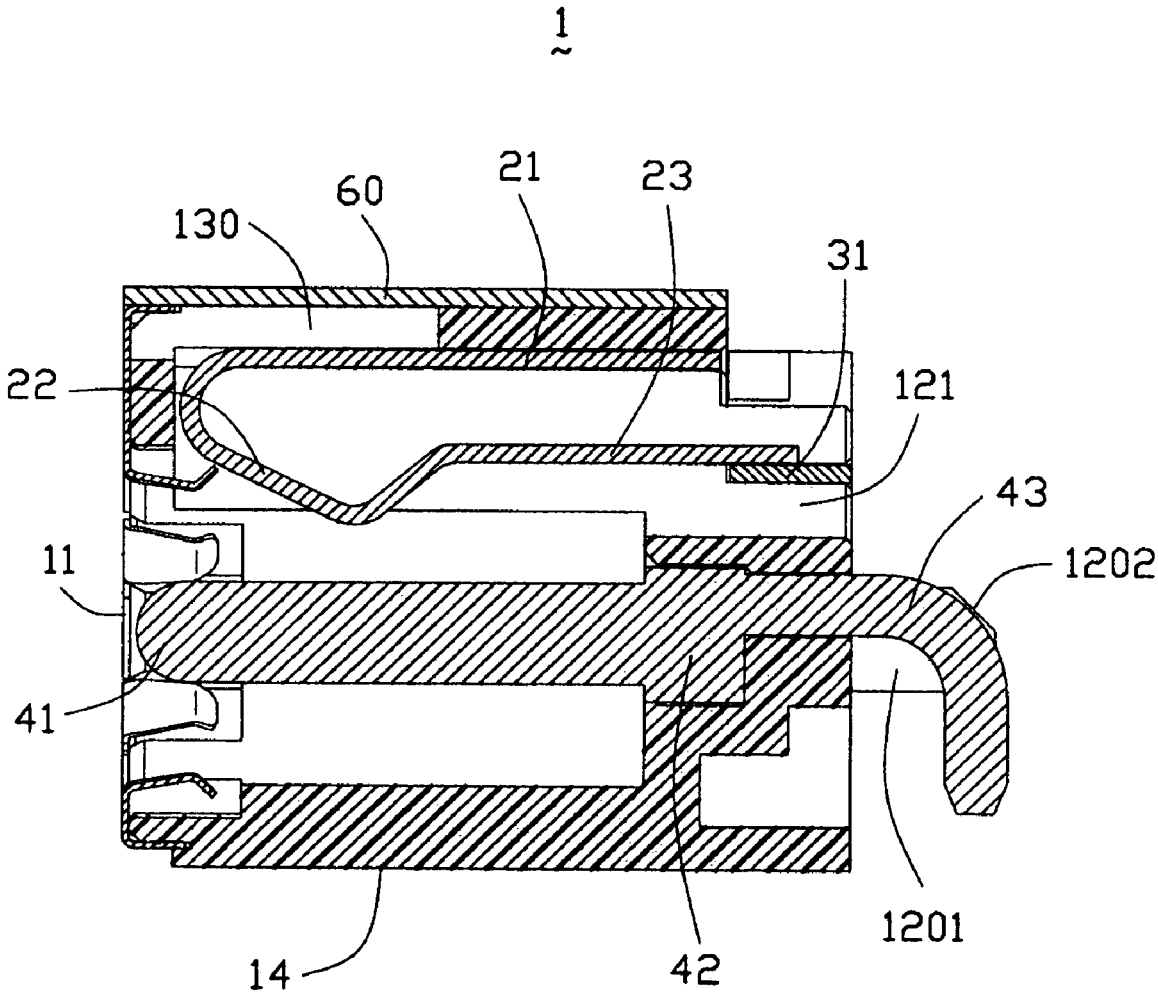
FIG. 4 is a cross-sectional view taken along line 4—4 shown in FIG. 2 showing assembly of a shield, a first contact, a second contact, an inspecting contact and the insulative housing of the electrical connector.

Referring to FIGS. 4 and 5, when the first contact 20 and the inspecting contact 30 are assembled in the housing 10, the main body 21 of the first contact 20 and the main body 31 of the inspecting contact 30 span in the first receiving passage 123, 124 and the second receiving passage 126, 127 respectively. The connecting portion 24 of the first contact 20 and the connecting portion 32 of the inspecting contact 30 receive in the corresponding first slot 125 and the second slot 128 respectively. The soldering portion 25 of the first contact 20 extends out of the corresponding one side of the side faces 15 and the soldering portion 33 extends out of the opposite side of the side faces 15. The contacting portion 22 and the jointing portion 23 exposes into the rectangle aperture 121 and the jointing portion 23 joins with the main body 31 of the inspecting contact 30.

Referring to FIGS. 1, 3 and 4, the second contact 40 is a single piece and comprises an engaging portion 41 for engaging with the complementary connector (not shown) protruding into the receiving chamber 16 of the housing 10 and apart from the contacting portion 22 of the first contact 20, a retaining portion 42 and a soldering portion 43 for soldering on a printed circuit board. The engaging portion 41, the retaining portion 42 and the soldering portion 43 are all in the shape of columns and the engaging portion 41 and the retaining portion 42 are coaxial along a same longitudinal axis, the axis of the soldering portion 43 isn't in alignment with that of the engaging portion 41 and that of the retaining portion 42. A diameter of the retaining portion 42 is approximately equal to the diameter (d1) of the front section 17, and a diameter of the soldering portion 43 is approximately equal to the diameter (d2) of the rear section 18. Referring to FIGS. 4 and 5, when the second contact 40 is inserted into the receiving chamber 16 through from the front face 11 of the housing 10, the soldering portion 43 protrudes out of the housing 10 throughout the front section 17 and the rear section 18 while the retaining portion 42 being blocked off before the rear section 18 because the diameter (d1) of the retaining portion 42 is larger than the diameter (d2) of the rear portion 18. Thus the second contact 40 is prevented from being pushed backwards while the complementary connector (not shown) being inserted into housing 10. The soldering portion 43 is clamped between the projections 120 after it protrudes out of the rear face 12 of the housing 10 and then is bent down at position of the sloping portion 1202, thus the bent portion of the soldering portion 43 is received between the projections 120 and warded off behind the opposite blocks 1201 of the projections 120. So the second contact 40 is prevented from being pulled forwards together with the complementary connector (not shown) while the complementary connector being drawn out of the housing 10.

Figure 2:
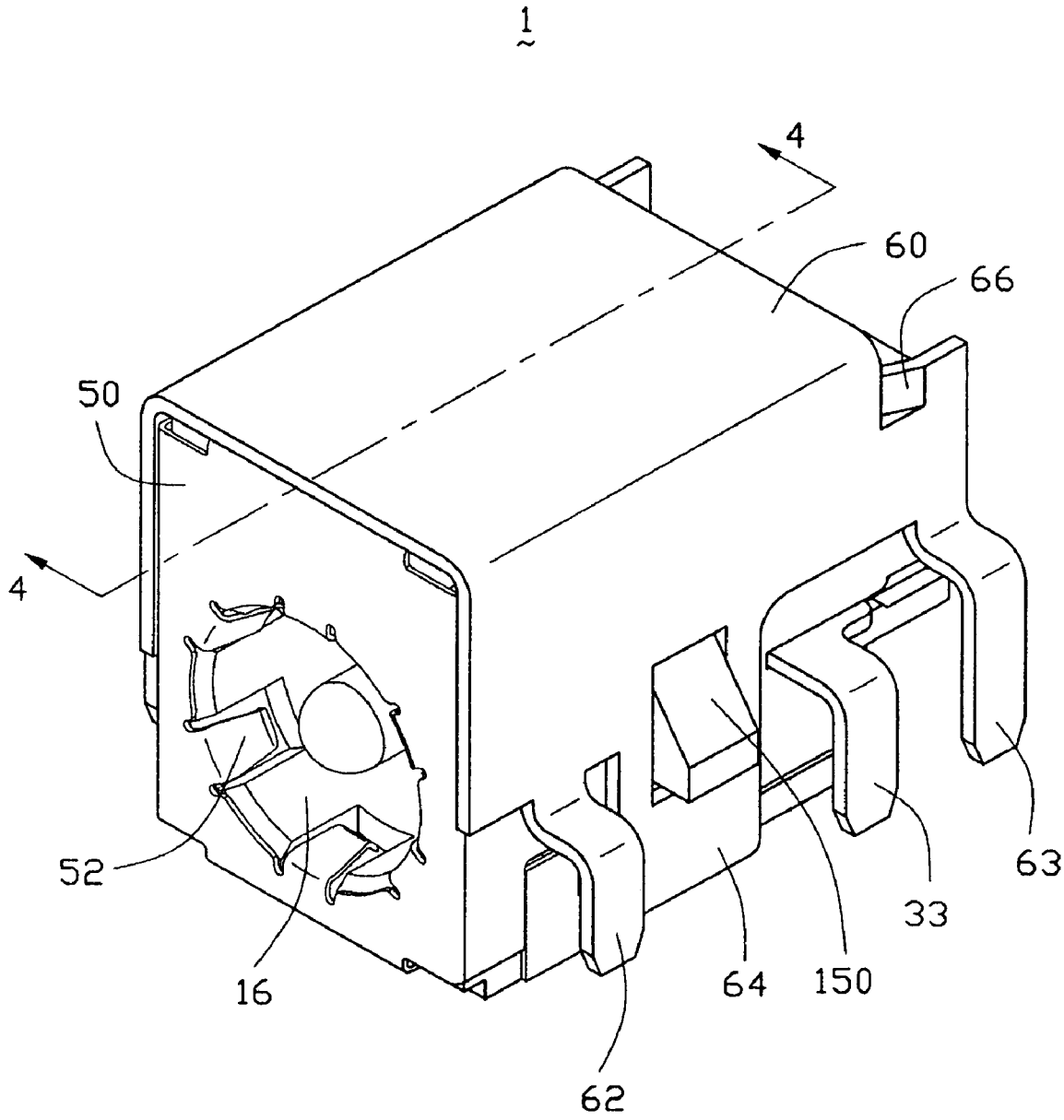
FIG. 2 is an assembled perspective view of the electrical connector of FIG. 1.

Referring to FIGS. 1, 2 and 5, the front shield 50 is installed to the front face 11of the housing 10. A hole 51 having a same diameter with and being coaxial with the receiving chamber 16 is defined in the center of the front shield 50. A pair of contacting pieces 53 are formed at two opposite sides of the front shield 50 and cover the edges of the top face 13 and the bottom face 14 adjacent the front face 11. A pair of wings 54 are formed at another two opposite sides of the front shield 50 and a pair of gaps 55 are formed at two opposite sides of each of the wings 54, the pair of wings 54 cover the edges of the side faces 15 adjacent the front face 11 by gaps 55 engaging with the protruding portion 152 of the housing 10.

The rear shield 60 is approximately in the shape of "U" and has a pair of side walls 61. A pair of soldering arms 62, 63 are formed respectively at two opposite sides of each of the side walls 61 adjacent the front face 11 and the rear face 12 (referring to FIG. 2). A pair of holding portions 64 are formed on the corresponding side walls 61 and each of the holding portions 64 is between the corresponding soldering arms 62, 63 on the same side wall 61. The holding portions 64 of the rear shield 60 are provided with two notches 65 corresponding to the protuberances 150 on the side faces 15 of the housing 10. Two colliding portions 66 are formed on the rear shield 60 corresponding to the step portion 122 of the housing 10. After the rear shield 60 is mounted on the housing 10, the protuberances 150 of the housing 10 are held in the notches 65 and the holding portions 64 are locked in the concaves 141, 142 of the bottom face 14 respectively, the colliding portions 66 are collided with the housing 10 to prevent the housing 10 from being pushed backwards while the complementary connector being inserted into the housing 10. Meantime, the soldering portion 25 of the first contact 20 and the soldering portion 33 of the inspecting contact 30 are located between the corresponding soldering arms 62, 63 on the same side wall 15 after the soldering portion 25, 33 extend out of the side walls 15 of the housing 10. Thus the majority of the pushing force is befell on the soldering portion 63 of the rear shield 60 while the complementary connector being inserted into the housing 10 and the majority of the pulling force is befell on the soldering portion 62 of the rear shield 60 while the complementary connector being drawn out of the housing 10, and the pushing/pulling force befell on the conductive contacts is little.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

an insulating housing comprising a mating face and a pair of side faces and defining a receiving chamber extending through the mating face along a mating direction thereof;

a first contact disposed in the housing and comprising a contacting portion exposed into the receiving chamber and a soldering portion located outside one of the side faces of the housing;

a second contact received in the housing and comprising an engaging portion protruding into the receiving chamber and located apart from the contacting portion of the first contact; and a shield covering the housing and formed with a pair of soldering arms located outside the one of the side faces of the housing and spaced from each other along the mating direction, the soldering portion of the first contact located between the two soldering arms of the shield outside the one of the side faces of the housing; wherein the second contact comprises a retaining portion and a soldering portion extending beyond a rear face of the housing, the retaining portion connects the engaging portion with the soldering portion; wherein the engaging portion, the retaining portion and the soldering portion are all in the shape of columns; wherein the retaining portion is larger than the engaging portion in diameter thereof and a diameter of the engaging portion is larger than that of the soldering portion.

2. The electrical connector as described in claim 1, further comprising an inspecting contact disposed in the housing and comprising a soldering portion located outside an opposite side face of the housing.

3. The electrical connector as described in claim 1, wherein the soldering portion of the second contact isn't coaxial with the engaging portion and the retaining portion of the second contact.

4. The electrical connector as described in claim 1, wherein the first contact comprises L-shaped portions received in the corresponding L-shaped slots formed in the side face of the housing.

5. The electrical connector as described in claim 1, wherein the housing has protuberances formed on the side faces thereof, and wherein the shield has notches defined on sidewalls thereof for engaging with the protuberances.

6. The electrical connector as described in claim 1, wherein the housing has concaves on a bottom face thereof, and wherein the shield has holding portions on sidewalls thereof for buttoning in the concaves.

7. The electrical connector as described in claim 1, wherein the housing has a space formed on a bottom face thereof.

8. The electrical connector as described in claim 4, wherein the pair of soldering arms of the shield extend from sidewalls of the shield and located outside the corresponding side faces of the housing.

9. An electrical connector comprising:

an insulative housing defining a circular mating port extending along a mating direction and located between opposite first and second sidewalls in a transverse direction perpendicular to said mating direction;

a first conductive contact disposed in the housing with a contact portion extending into the mating port and a tail portion laterally extending from the mating port with a mounting portion around the first sidewall for mounting to a printed circuit board;

a second conductive contact received in the housing and comprising an engaging portion protruding into a receiving chamber and located apart from the contacting portion of the first contact; and a metallic shell including at least a first plate covering the fast sidewall and including a pair of mounting legs for mounting to the printed circuit board; wherein said pair of mounting legs are located by two sides of said mounting portion along said mating direction; wherein the first conductive contact essentially locates above the mating port of the housing; wherein the second conductive contact comprises a retaining potion and a soldering portion extending beyond a rear face of the housing, the retaining portion connect the engaging portion with the soldering portion; wherein the engaging portion, the retaining portion and the soldering portion are all in the shape of columns; wherein the retaining portion is larger than the engaging portion in diameter thereof and a diameter of the engaging portion is larger than that of the soldering portion.

10. An electrical connector comprising:

an insulative housing defining a mating port extending along a mating direction and located between opposite first and second sidewalls in a transverse direction perpendicular to said mating direction;

a first conductive contact disposed in the housing with a contact portion extending around the mating port and a tail portion laterally extending away from the mating port with a mounting portion around the first sidewall for mounting to a printed circuit board; and a second conductive contact received in the housing and comprising an engaging portion protruding into a receiving chamber and located apart from the contacting portion of the first contact;

a metallic shell including at least a first plate intimately covering the first sidewall and including a pair of mounting legs for mounting to the printed circuit board; wherein said pair of mounting legs are located by two sides of said mounting portion along said mating direction; wherein the first conductive contact comprises an L-shaped portions received in a corresponding L-shaped slots formed in the side face of the housing; wherein the first conductive contact essentially locates above the mating port of the housing; wherein the second conductive contact comprises a retaining potion and a soldering portion extending beyond a rear face of the housing, the retaining portion connect the engaging portion with the soldering portion; wherein the engaging portion, the retaining portion and the soldering portion are all in the shape of columns; wherein the retaining portion is larger than the engaging portion in diameter thereof and a diameter of the engaging portion is larger than that of the soldering portion.

* * * * *